United States Patent [19]

Dlugokecki

[11] Patent Number: 4,824,347

[45] Date of Patent: Apr. 25, 1989

[54] INTERNAL GEAR MACHINE WITH REINFORCED HOUSING

[75] Inventor: Andrew N. Dlugokecki, Bridgton, Me.

[73] Assignee: Parker Hannifin Corporation, Cleveland, Ohio

[21] Appl. No.: 100,520

[22] Filed: Sep. 24, 1987

[51] Int. Cl.[4] ..... F03C 2/08; F04C 2/113

[52] U.S. Cl. ..... 418/61.3

[58] Field of Search ..... 418/61 B, 160

[56] References Cited

U.S. PATENT DOCUMENTS

| | | | |
|---|---|---|---|
| 3,846,051 | 11/1974 | McDermott | 418/61 B |
| 3,905,727 | 9/1975 | Kilmer | 418/61 B |
| 4,025,243 | 5/1977 | Stephens | 418/61 B |
| 4,411,607 | 10/1983 | Wusthof et al. | 418/61 B |

*Primary Examiner*—John J. Vrablik

*Attorney, Agent, or Firm*—Christopher H. Morgan

[57] ABSTRACT

A reinforced internal gear machine of the type having variable displacement fluid chambers formed between an orbiting outer gear and a rotating inner gear. The orbiting outer gear is retained in its orbiting motion by a plurality of roller dowells closely fitting in a locating ring disposed radially outside the outer gear and extending therefrom to be received in arcuate recesses on the radial outside of the outer gear as it orbits. The locating ring is connected to an end piece of internal gear machine along a plane of torsional stress and this connection is reinforced by this invention. The reinforcement is made by the end piece having recesses disposed coaxially with the roller dowells and the roller dowells extending closely within these recesses from the cover. The roller dowells thus extend across the plane of torsional stress for reinforcement.

2 Claims, 2 Drawing Sheets

INTERNAL GEAR MACHINE WITH REINFORCED HOUSING

BACKGROUND OF THE INVENTION

1. Field of the Invention

The present invention relates generally to gerotor hydraulic devices that can be used as pumps or motors and, more particularly, to such devices having an orbiting outer gear disposed within a cover connected to the gear machine body.

2. Description of the Prior Art

Many types of prior art hydraulic and pneumatic devices have utilized internal gear sets which are often called gerotors or rotors. Such devices can be used as pumps where shaft work is converted to hydraulic work and as motors where hydraulic work is converted to shaft work. Examples of gerotor pumps and motors are shown in U.S. Pat. Nos. 3,572,983; 4,411,607; 4,545,748; and 4,586,885. In an internal gear pump or motor, an inner gear or rotor having outwardly directed teeth cooperates with an external gear or rotor having inwardly directed teeth so that fluid chambers therebetween increase and decrease in volume as the inner and outer gears rotate in a housing. In one particular type of gerotor pump or motor, the inner gear rotates while the outer gear orbits in a cavity defined by a locating ring (a ring which locates the rotor set between the body parts) disposed radially outside of the outer gear. Extending radially along the inside of the locating ring are a plurality of cylindrical roller dowells which serve as guides to retain the outer gear in its orbital motion. These roller dowells are received in arcuate recesses on the radial outside of the outer gear. As the inner gear rotates, the corresponding motion of the outer gear is an orbiting motion because of the roller dowells being received in the arcuate recesses of the outer gear. The variable displacement chambers formed between the inner and outer gear as the outer gear orbits and the inner gear rotates function to transfer work between the fluid in the chambers and the rotating shaft connected to the inner gear.

A significant problem with the prior art arises because the locating ring is connected to the pump or motor by a plurality of bolts which receive a very significant stress as the shaft starts and stops. For example, if the shaft is connected to a wheel driven by the hydraulic power of the motor, the wheel can be subjected to significant torsional stresses, all of which are received by the bolts which hold the locating ring in the motor. Generally, the point of failure of the motor is at the bolts so that the bolts are sheared off and the motor is broken between the locating ring and the motor body. Although it is possible to make the bolts larger and the locating ring thicker, there are also often size requirements with respect to the motor which make this difficult to accomplish. Therefore, it would be desirable to strengthen the connection between the locating ring and body without increasing the size of the locating ring and bolts.

It is accordingly an object of the present invention to provide an improved internal gear motor or pump of the type having an orbiting outer gear. More specifically, it is an object to provide such an internal gear device with a reinforced connection between the locating ring and body without the necessity of increasing the size of the device or the size of the bolts. Still further, it is an object of the present invention to provide such an improvement without significant additional construction costs and having a relatively simple design.

SUMMARY OF THE INVENTION

In accordance with the objects, the present invention provides an improved internal gear machine with a housing and locating ring reinforced against torsional stresses. The reinforcement comprises having formed in a gear machine end piece cylindrical recesses extending coaxially with the roller dowells and sized to closely receive the roller dowells. The roller dowells of a conventional pump or motor are replaced with longer roller dowells which extend not only within the cylindrical locating ring, but also into the cylindrical recesses extending coaxially in the gear machine end piece so as to reinforce the connection between the locating ring and the gear machine body.

For a further understanding of the invention and further objects, features and advantages thereof, reference may now be had to the following description taken in conjunction with the accompanying drawings.

DESCRIPTION OF PREFERRED EMBODIMENTS

The present invention provides an improved internal gear motor or pump of the type shown in Applicant's co-pending U.S. patent application, Ser. No. 860,715, filed May 6, 1986; U.S. Pat. No. 4,699,577, Applicant's co-pending U.S. patent application, Ser. No. 082,754, filed Aug. 6, 1987; and U.S. Pat. No. 4,586,885. The operation of the internal gears and other parts of the machine are well known in the art and are described in these documents. To the extent the general description of the operation of these parts is not described herein, the descriptions in these documents are hereby incorporated by reference.

Figure 1:
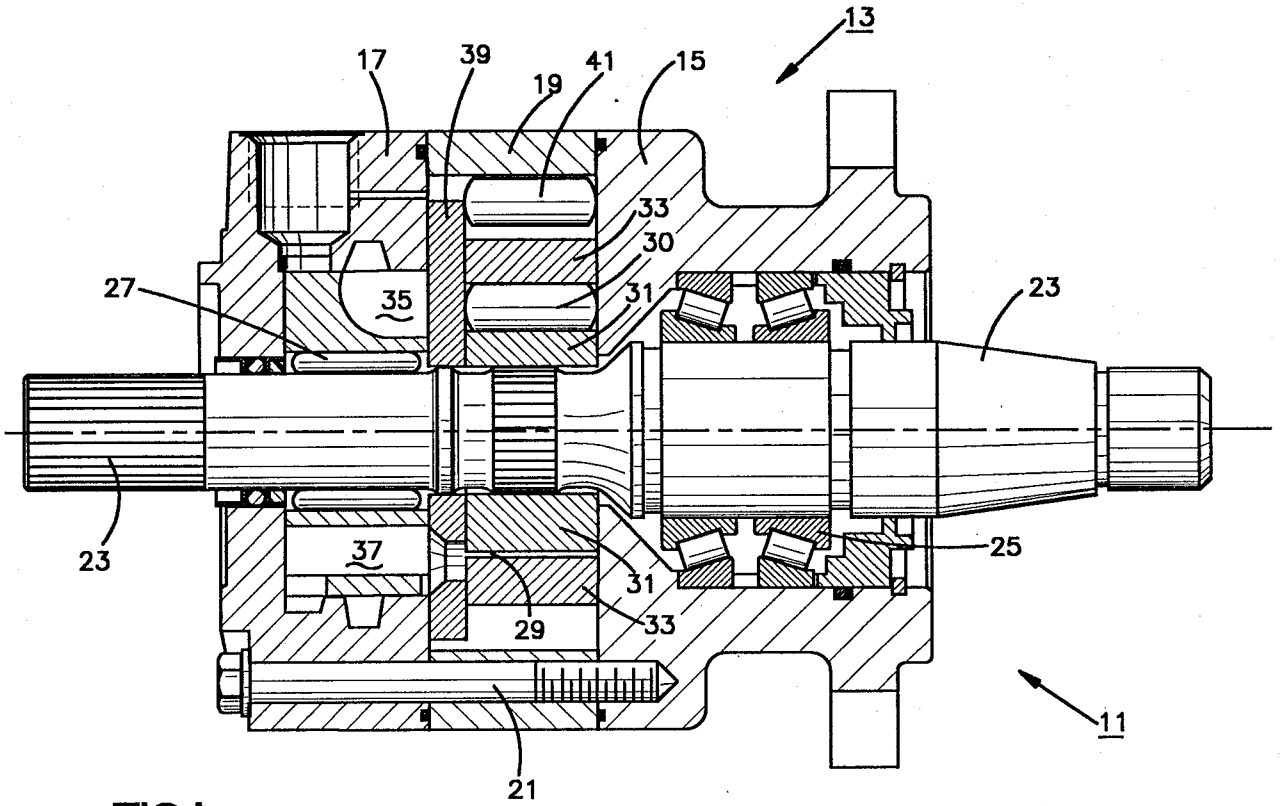
FIG.1 (PRIOR ART)
FIG. 1 is a cross sectional view of a prior art internal gear machine.

Referring now to FIG. 1, a prior art internal gear pump or motor is shown in cross sectional view through the axis of the machine shaft. The machine 11 comprises a cylindrical housing 13 formed of body 15, cover 17 and locating ring 19. The body 15 and cover 17 are axial end portions of the housing 13 and the locating ring 19 defines the cavity therebetween in which the rotor set and valve plate rotate. These three portions of the housing are held together by a plurality of bolts 21.

Extending through the axial center of the housing 13 is a shaft 23. The shaft 23 is retained for rotation in the housing 13 by bearings 25 and 27. In the case of a motor, the shaft 23 is driven by hydraulic work in variable displacement chambers 29 between an inner gear 31 and an outer gear 33 (the rotor set). Rolls 30 extend as teeth of the gear 31 in the meshing of the rotor set. Hydraulic fluid is conveyed to and from the variable displacement chambers 29 through an inlet 35 and an outlet 37 disposed in cover 17. A valve plate 39 regulates the flow of fluid into and out of the variable displacement chambers 29 as it rotates with a plurality of openings therein.

The internal gear machine shown in FIG. 1 is of a type wherein the outer gear 33 orbits while the inner gear 31 rotates. This motion is dictated by the roller dowells 41 which are closely received in cylindrical cavities spaced about the radial inside of the locating ring 19. These roller dowells serve as guides or teeth to cause the outer gear 33 to orbit instead of rotate in the cavity 43 between the outer gear 33 and the locating ring 19.

Figures 2, 3:
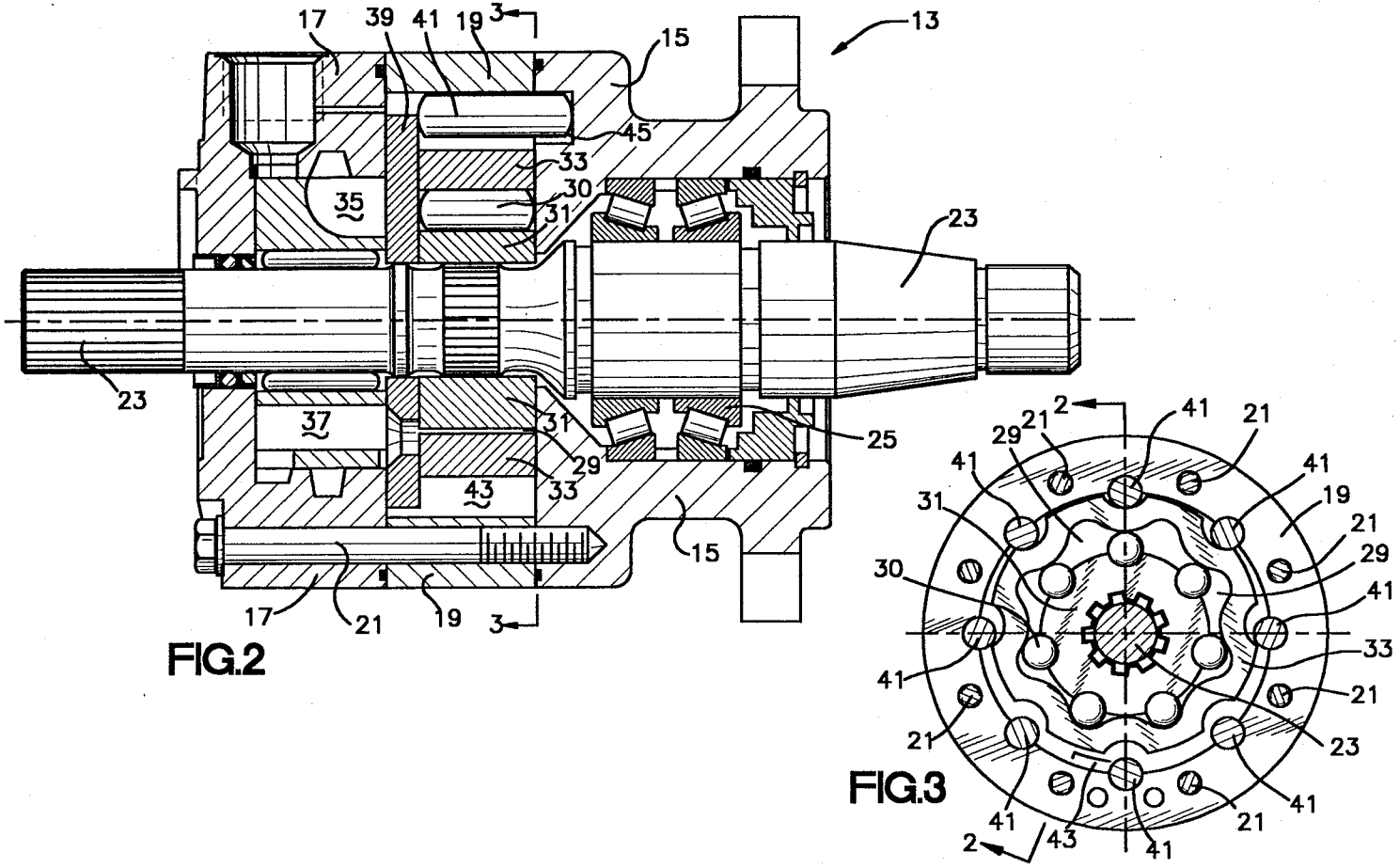
FIG. 2 is a cross sectional view of an internal gear machine of the present invention taken along the same lines as the device shown in FIG. 1.
FIG. 3 is a cross sectional view of the internal gear machine shown in FIG. 2 taken along the lines shown in FIG. 2.

As shown in FIG. 1, the roller dowells 41 of the prior art extend between the valve plate 39 and the body 15 on the opposite side of the valve plate 39. As shown in FIGS. 2 and 3, the present invention differs from the prior art in that the roller dowells 41 extend into cylindrical recesses 45 in the internal gear machine body 15. The recesses 45 are sized to closely receive the roller dowells 41. The roller dowells 41 thus extend from the valve plate 39 sufficiently into the body 15 so as to reinforce the connection between the locating ring 19 and the body 15. In the prior art this junction was supported solely by the bolts 21. Because the roller dowells 41 are closely received in the locating ring 19 and in the cavities 45 of the body 15, the roller dowells 41 reinforce the connection between the locating ring 19 and the body 15 against torsional stresses.

In operation, as the internal gears 31, 33 rotate the shaft 23 with respect to the body 15, the torsional stress of this work is received along the plane or junction between the locating ring 19 and the body 15. This is the same plane as that along which FIG. 3 is taken. Also, as stresses are exerted on the shaft 23 by a wheel or the like, these stresses are again received at the same location. In the prior art, all of these torsional stresses were concentrated on the bolts 21. Although tightening these bolts increases the friction forces between the locating ring 19 and the body 15, this still does not provide sufficient reinforcement to prevent the shearing of the bolts 21.

This problem of bolt failure at this point is increased by repeated working of the bolts as these stresses cycle on the bolts 21. By means of the present invention, a reinforcement is provided for the connection between the locating ring 19 and the body 15 by means of the extended roller dowells 41. This improvement is achieved without significant additional expenditure simply by boring the cylindrical cavities 45 and providing longer roller dowells 41.

In fact, longer roller dowells 41 can be replaced by stacking a short roller dowell as shown in the prior art FIG. 1 and a shorter roller dowell which is received adjacent the valve plate 39 so that the longer dowell extends across the plane between the locating ring 19 and the body 15. In this way standard shorter roller dowells can be stacked so as to avoid production of a new longer roller dowell.

In some hydraulic pumps or motors, the valve plate is disposed on the opposite side of the rotor set from the arrangement depicted in FIGS. 1 through 3. In this case the roller dowells 41 cannot be extended into body 15 but can be extended into the cover 17. Although this does not provide a reinforcement at the junction between the body 15 and locating ring 19 (the plane of maximum torsional stress in the motor because body 15 receives greater torsional stress than the cover 17), it does provide a significant improvement over a motor which has only the bolts 21 for connection. By means of reinforcing the cover/locating ring connection, the motor is stiffened which reduces the working stresses at the body/locating ring junction. This reduces the tendency of the bolts 21 to fail at the body/locating ring junction even though the reinforcement of the roller dowells is concentrated at the cover/locating ring junction. Thus, the present invention may include an improvement whereby the roller dowells extend into close fitting cavities in either end portion of the motor. Of course, it is better to reinforce the motor at the end portion receiving the greater torsional stress.

Thus, the improved internal gear device of the present invention is well adapted to achieve the objects and advantages mentioned, as well as those inherent therein. While presently preferred embodiments of the present invention have been described for the purpose of this disclosure, numerous changes in the construction and arrangements of parts can be made by those skilled in the art, which changes are encompassed within the spirit of this invention as defined by the appended claims.

The foregoing disclosure and the showings made in the drawings are merely illustrative of the principles of this invention and are not to be interpreted in a limiting sense.

What is claimed is:

1. An improved internal gear machine of the type having variable displacement fluid chambers formed between a rotating inner gear and an orbiting outer gear, the orbiting outer gear being retained in an orbiting motion by a plurality of roller dowells received in arcuate recesses on the radial outside of the outer gear and closely fitting in a locating ring disposed radially outside the outer gear, the locating ring being connected to a gear machine end piece; the improvement comprising:

said gear machine end piece having cylindrical recesses extending coaxially with said roller dowells and sized to closely receive said roller dowells; and said roller dowells extending closely within said cylindrical recesses from said locating ring so as to reinforce the connection between said locating ring and said gear machine end piece against torsional stresses.

2. The improved internal gear machine of claim 1 wherein the gear machine has two end pieces, one of which receives greater torsional stresses than the other, said one being the end piece having said cylindrical recesses receiving said roller dowells.

* * * * *